US008056476B2

(12) United States Patent
Sitzmann et al.

(10) Patent No.: US 8,056,476 B2
(45) Date of Patent: Nov. 15, 2011

(54) METHOD FOR OPERATING A PRINTING PRESS AND PRINTING PRESS IMPLEMENTING THE METHOD

(75) Inventors: Bernd Sitzmann, Sandhausen (DE); Markus Uihlein, Heidelberg (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 141 days.

(21) Appl. No.: 12/426,312

(22) Filed: Apr. 20, 2009

(65) Prior Publication Data

US 2009/0260530 A1 Oct. 22, 2009

(30) Foreign Application Priority Data

Apr. 21, 2008 (DE) ..... 10 2008 019 939

(51) Int. Cl.
*B41F 35/00* (2006.01)

(52) U.S. Cl. ..... 101/425; 101/483

(58) Field of Classification Search ..... 101/425
See application file for complete search history.

(56) References Cited

U.S. PATENT DOCUMENTS

| | | | | |
|---|---|---|---|---|
| 3,989,929 | A * | 11/1976 | Treiber | 235/432 |
| 4,986,182 | A * | 1/1991 | Sawaguchi et al. | 101/483 |
| 5,150,653 | A * | 9/1992 | Hara | 101/483 |
| 5,289,774 | A * | 3/1994 | Stanka | 101/423 |
| 5,390,602 | A * | 2/1995 | Gorl | 101/425 |
| 5,727,470 | A * | 3/1998 | Kurzer et al. | 101/425 |
| 5,758,577 | A * | 6/1998 | Ebina | 101/423 |
| 6,308,627 | B1 | 10/2001 | König et al. | |
| 6,412,414 | B1 * | 7/2002 | Loos | 101/425 |
| 6,616,084 | B1 * | 9/2003 | Sitzmann | 242/534 |
| 6,732,652 | B2 | 5/2004 | Loos et al. | |
| 7,506,585 | B2 * | 3/2009 | Kundgen et al. | 101/483 |
| 2003/0000407 | A1 | 1/2003 | Schmutz | |
| 2006/0236883 | A1 | 10/2006 | Kundgen et al. | |

FOREIGN PATENT DOCUMENTS

| | | | |
|---|---|---|---|
| DE | 3614542 | A1 | 11/1987 |
| DE | 4221026 | A1 | 1/1994 |
| DE | 4326833 | A1 | 2/1995 |
| DE | 19958087 | A1 | 6/2000 |
| DE | 10244218 | A1 | 4/2003 |
| DE | 102006013748 | A1 | 10/2006 |
| EP | 1244552 | B1 | 7/2003 |

OTHER PUBLICATIONS

German Search Report dated Nov. 12, 2008.

* cited by examiner

*Primary Examiner* — Anthony Nguyen
(74) *Attorney, Agent, or Firm* — Laurence A. Greenberg; Werner H. Stemer; Ralph E. Locher

(57) ABSTRACT

A method for operating a printing press having a printing unit and a cleaning apparatus includes, in a first step, starting up the printing unit in order to print therewith, and in a subsequent, second step, displacing the cleaning apparatus into the printing unit running in printing operation and/or out of the printing unit running in printing operation. A printing press for implementing the method is also provided.

9 Claims, 4 Drawing Sheets

METHOD FOR OPERATING A PRINTING PRESS AND PRINTING PRESS IMPLEMENTING THE METHOD

CROSS-REFERENCE TO RELATED APPLICATION

This application claims the priority, under 35 U.S.C. §119, of German Patent Application DE 10 2008 019 939.7, filed Apr. 21, 2008; the prior application is herewith incorporated by reference in its entirety.

BACKGROUND OF THE INVENTION

Field of the Invention

The present invention relates to a method for operating a printing press which has a printing unit and a cleaning apparatus. The invention also relates to a printing press for implementing the method.

Cleaning apparatuses have to be removed from the printing unit for the purpose of their maintenance, for example in order to replace a cleaning cloth. During its maintenance, the cleaning apparatus can lie on a table which stands beside the printing press or lie on a foot board of the printing press.

In German Published, Non-Prosecuted Patent Application DE 10 2006 013 748 A1, corresponding to U.S. Patent Application Publication No. US 2006/0236883 A1, a method for operating a printing press is described in which the cleaning apparatus lies on a foot board of the printing press during its maintenance. The cleaning apparatus lying on the foot board is located outside the printing unit, which has an opening that can be closed by a protective covering. As a result of closing the opening with the protective covering, it is possible to operate the printing unit in the printing operation with the cleaning apparatus removed therefrom and lying on the foot board. The disadvantage is that the printing operation has to be interrupted in order to displace the cleaning apparatus into the printing unit again after the maintenance of the former has been carried out. In order to displace the cleaning apparatus from the foot board into the printing unit, it is necessary to pivot the protective covering away from the opening, so that the cleaning apparatus can be displaced through the opening into the printing unit. At the end of its displacement into the printing unit, the cleaning apparatus reaches an operating position, in which the cleaning apparatus is located close enough to the blanket cylinder of the printing unit to be cleaned. The machine running or printing operation of the printing unit has to be interrupted for the displacement of the cleaning apparatus into the printing unit, since otherwise there would be the danger that, in the event of too low a tension of the cleaning cloth, the latter would remain stuck to the circumferential surface of the rotating blanket cylinder, which would result in complications.

In German Published, Non-Prosecuted Patent Application DE 102 44 218 A1, corresponding to U.S. Pat. No. 6,732,652, complications and a countermeasure are described. The complications reside in the fact that, because of the rotation of the blanket cylinder, the cleaning cloth remaining stuck thereto is pulled by the latter, forming a loop, in the direction of a cylinder nip formed by the blanket cylinder together with an adjacent printing unit cylinder. It is not impossible for the loop of the cleaning cloth to be pulled into the cylinder nip, so that firstly there would be the danger that the cleaning cloth is torn as it is drawn in and consequently becomes unusable and, secondly, there would be the much more serious danger that the cleaning cloth drawn in causes consequential damage within the printing press. Such consequential damage can be realized, for example, in the cleaning cloth being wound up on the blanket cylinder and forming a plurality of layers of cloth on the blanket cylinder, which together are thicker than the cylinder nip and, within the cylinder nip, press the blanket cylinder and the adjacent cylinder so far apart that a considerable amount of the cylinder bearing loading is exceeded and the cylinder bearings are consequently damaged. The countermeasure already mentioned is realized in an accident monitoring device which has a wire stretched along the cylinder, that is connected to a sensor. The cleaning cloth carried along by the blanket cylinder strikes the wire, so that the sensor responds and, consequently, the machine running is interrupted and thus the rotation of the blanket is stopped. The disadvantage in that case is that the accident monitoring device reacts only after the cleaning cloth has remained stuck to the blanket cylinder and the loop has formed. As a result of the cleaning cloth remaining stuck and the formation of the loop, firstly a considerable section of the cleaning cloth becomes unusable and a certain amount of repair time is required, during which the loop is eliminated and the cleaning cloth put in order again.

In European Patent EP 1 244 552 B1, corresponding to U.S. Patent Application Publication No. US 2003/0000407 A1, a method is described in which the cleaning cloth is automatically re-tensioned during the displacement of the cleaning apparatus toward the cylinder. As a result of the re-tensioning of the cleaning cloth, usually even in that case in which the cleaning cloth is not yet tensioned sufficiently tautly in the cleaning apparatus as the latter is inserted into holders leading toward the cylinder, the cleaning cloth is prevented from remaining stuck to the cylinder and the carrying along of a loop of the cleaning cloth by the cylinder is avoided. The re-tensioning of the cleaning cloth is effected in that, as a consequence of the displacement of the cleaning apparatus toward the cylinder, a lever arm of the cleaning apparatus strikes a stop and in the process is actuated by the stop. Since, during that type of re-tensioning, a section length of the cleaning cloth determined by the mechanical conditions is wound up, the section length is the same during each re-tensioning process, and no monitoring of the achievement of the necessary cloth tension is carried out, that method from the prior art fails in cases of formations of unusually large loops. It is not possible to gather from the last-named patent publication any explicit reference to the operating state, the printing operation or the printing operation interruption in which the printing press is found during the displacement of the cleaning apparatus toward the cylinder and the associated re-tensioning of the cleaning cloth. However, it may be assumed that the printing press is at a standstill during the displacement of the cleaning apparatus, since in specialist circles the opinion prevails that displacement of a cleaning apparatus into a printing unit running in printing operation and out of the printing unit running in printing operation is much too risky and dangerous.

SUMMARY OF THE INVENTION

It is accordingly an object of the invention to provide a method for operating a printing press and a printing press implementing the method, which overcome the hereinaforementioned disadvantages of the heretofore-known methods and devices of this general type and with which machine stoppage times are avoided.

With the foregoing and other objects in view there is provided, in accordance with the invention, a method for operating a printing press having a printing unit and a cleaning apparatus. The method comprises in a first step, starting the printing unit to print with the printing unit, and in a subsequent, second step, displacing the cleaning apparatus into and/or out of the printing unit during running of the printing unit in printing operation.

Within the context of the present invention, the previously mentioned prejudice within the specialist circles has been overcome. It appears that the risks and dangers have heretofore been overestimated. In the method according to the invention, precisely that which was previously viewed as being categorically ruled out in specialist circles, is being done. It has transpired that, through the use of re-tensioning of the cleaning cloth carried out automatically during the displacement of the cleaning apparatus into the running printing unit, the risks mentioned can be minimized to a sufficient extent. In addition, the displacement of the cleaning apparatus out of the running printing unit is possible without relatively great risks.

Machine stoppage times are avoided by applying the method according to the invention. In particular, during the progress of a relatively large print job on the printing press, there is generally enough time available to be able to remove the cleaning apparatus from the printing unit during uninterrupted printing operation, to be able to maintain the cleaning device and, in the process, for example to be able to replace its cleaning cloth by a fresh one, and thereafter to be able to insert the cleaning apparatus into the printing unit again. This entire working sequence can be carried out by the operator without having to interrupt the machine run a single time. Since the resumption of printing operation following an interruption of the machine run would inevitably be associated with the production of more or less waste, the method according to the invention is advantageous not only with regard to the avoidance of stoppage times but also with regard to the avoidance of what is known as restart waste.

In accordance with another mode of the invention, the cleaning apparatus is moved into an operating position by the displacement carried out in the second step, and a cleaning cloth of the cleaning apparatus is automatically re-tensioned after the first step and before the cleaning apparatus has reached the operating position. The operating position can be a position close to a cylinder to be cleaned through the use of the cleaning apparatus, for example a blanket cylinder. The operating position can be a so-called locked position, in which the cleaning apparatus is locked. It is not absolutely necessary for the cleaning apparatus to come into contact with the surface to be cleaned, for example the circumferential surface of the cylinder or the blanket forming this circumferential surface, merely as a result of its displacement into the operating position. Instead, a further displacement of the cleaning cloth relative to the cleaning apparatus, following the displacement of the cleaning apparatus into the operating position can be provided, through the use of which the cleaning cloth is brought into contact with the surface to be cleaned. The automatic re-tensioning of the cleaning cloth is still carried out before the latter has reached the danger zone, within which, without the re-tensioning, the un-tautened cleaning cloth remaining stuck or a loop of the cleaning cloth on the rotating cylinder would pose a threat. As a result of the positive re-tensioning, sagging of the cleaning cloth or a loop of the cleaning cloth is reliably eliminated, so that the cleaning cloth is tautened sufficiently when the cleaning apparatus reaches the operating position. The automatic re-tensioning is carried out while the printing unit is running in printing operation.

In accordance with a further mode of the invention, the cleaning cloth is re-tensioned by the cleaning cloth being wound onto a spindle. This spindle can be a so-called clean-cloth spindle, from which, during the cleaning, the still unsoiled, fresh sections of the cleaning cloth are unwound. Apart from this clean-cloth spindle, the cleaning apparatus can include a so-called dirty-cloth spindle, on which, during cleaning, the sections of the cleaning cloth soiled as a result of the cleaning are wound up. During the re-tensioning of the cleaning cloth, a section of the cleaning cloth located between the clean-cloth spindle and the dirty-cloth spindle is tautened. That section runs with guidance over a pressing element which, during the cleaning of the cylinder, is used to press the cleaning cloth onto the circumferential surface of the cylinder. For the purpose of re-tensioning, provision can be made for the clean-cloth spindle to be driven in rotation first, in order as a result to wind the cleaning cloth up onto the clean-cloth spindle and to tauten it in the process, and thereafter for the dirty-cloth spindle to be driven in rotation, in order as a result to wind the cleaning cloth back onto the dirty-cloth spindle while preserving its tautness that has already been reached.

In accordance with an added mode of the invention, the tension of the cleaning cloth is monitored by a monitoring device. This monitoring can be carried out during the re-tensioning of the cleaning cloth. The monitoring device can have a sensor for this monitoring. The monitoring device can determine whether the cleaning cloth is already sufficiently tautened, so that sagging or a loop of the cleaning cloth is ruled out, or is not yet sufficiently tautened. During the re-tensioning, the monitoring device can determine the point at which the tension of the cleaning cloth has become high enough to ensure non-hazardous further operation of the printing unit with the cleaning apparatus located in the operating position.

In accordance with an additional mode of the invention, the tension of the cleaning cloth is monitored by the monitoring device determining whether a sensor or the sensor of the monitoring device responds within a specific time period, which begins with the activation of a drive of the spindle. With the activation of the drive of the spindle, the latter begins to rotate, which means that the cleaning cloth is wound onto the spindle. If the sag of the cleaning cloth that is to be eliminated by this winding is not excessively high, then the spindle needs to be rotated over only a small angle of rotation which is, for example, less than 360°, in order to eliminate the aforesaid sag and as a result to tauten the cleaning cloth to a sufficient extent. The spindle has covered this small angle of rotation comparatively quickly and at a time which lies within the specific time period. The sensor registers the sufficient tautness of the cleaning cloth directly or indirectly, and the monitoring device determines that the registration of the sufficient tautness of the cleaning cloth has been carried out by the sensor within the specific time period, and that, accordingly, no more danger originates from the cleaning cloth when the cleaning apparatus reaches the operating position in the course of its displacement. A rotational angle that is much larger and, for example, contains several rotations of the spindle would be required in order to eliminate an excessive sag of the cleaning cloth, which, for example, already forms a loop. The spindle is not able to cover this larger rotational angle within the specific time period, so that in this case sufficient tautening of the cleaning cloth is not achieved within the specific time period. Accordingly, when there is excessive cloth sag, the sensor does not respond within the specific time period, which is registered by the monitoring device. The monitoring device can be an electronic device, which can be programmed accordingly.

In accordance with yet another mode of the invention, the monitoring device interrupts the printing operation of the printing unit in the event that the specific time period is exceeded without the sensor responding. The monitoring device generates a so-called emergency stop signal and sends it to the central machine control system if the monitoring device does not receive a signal during the specific time period which signals to the monitoring device that the cleaning cloth has reached a sufficient tension as a result of the re-tensioning of the former.

In accordance with yet a further mode of the invention, the sensor being used is an incremental encoder. This incremental encoder, which is also designated a rotary encoder, can have a roller or be connected to such a roller which, in the cleaning mode, rolls on the tautened cleaning cloth when the latter is spooled or cycled onward. The incremental encoder is therefore used in the cleaning mode to measure the advance travel of the cleaning cloth during spooling. The sensor responds when the incremental encoder forming the sensor is rotated or rotated fast enough by the re-tensioning movement of the cleaning cloth.

With the objects of the invention in view, there is concomitantly provided a printing press for implementing the method according to the invention or corresponding to one of the developments thereof. This printing press is preferably a sheet-fed printing press and the printing unit of this printing press is preferably an offset printing unit. The printing unit includes a cylinder that can be cleaned through the use of the cleaning apparatus and which is preferably a blanket cylinder. The cleaning apparatus is preferably a washing device which has a cleaning cloth as a cleaning element.

Other features which are considered as characteristic for the invention are set forth in the appended claims.

Although the invention is illustrated and described herein as embodied in a method for operating a printing press and a printing press implementing the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
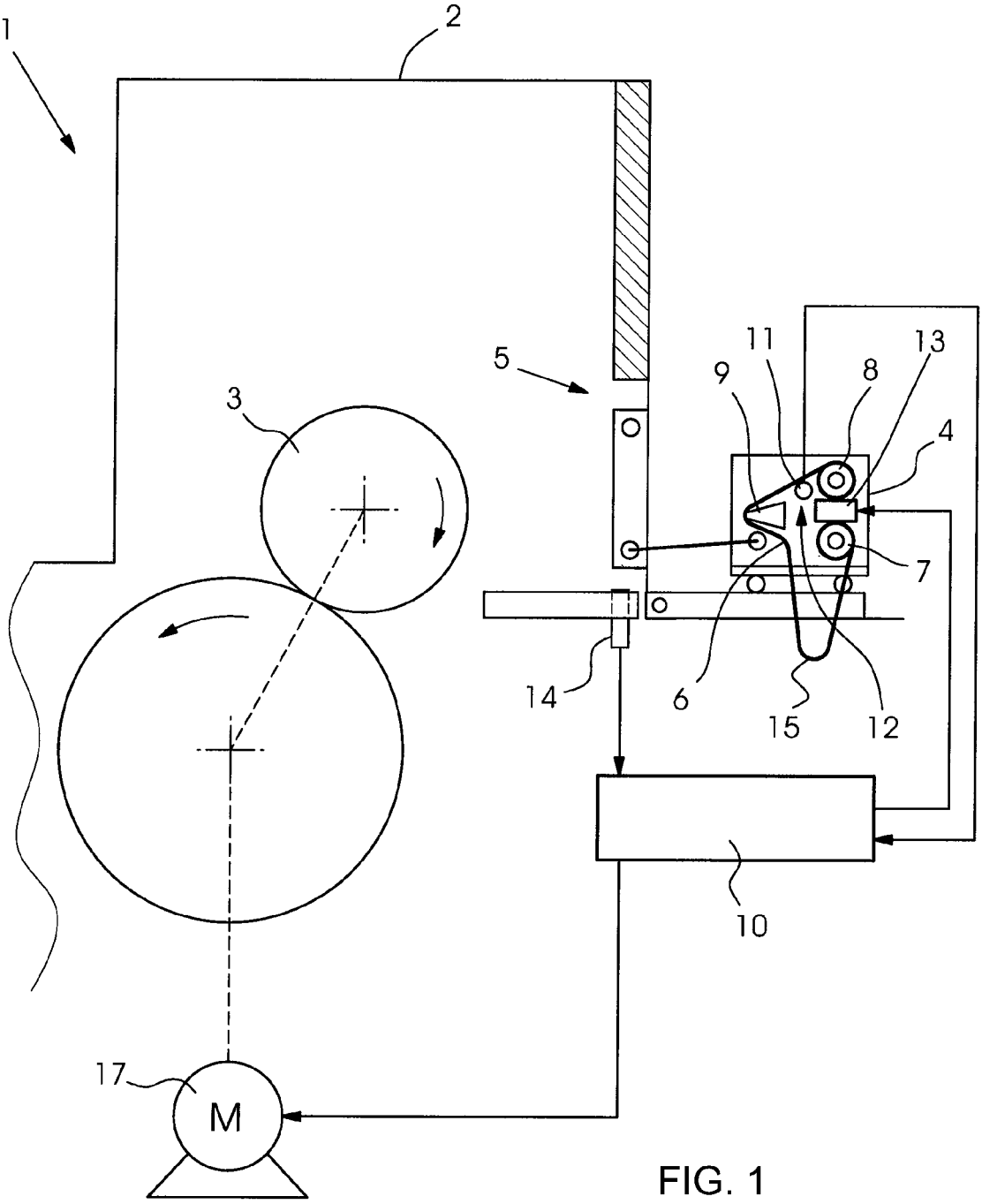
FIG. 1 is a fragmentary, diagrammatic, side-elevational view of a printing press having a printing unit and a cleaning apparatus positioned outside the printing unit.

Referring now to the figures of the drawings in detail and first, particularly, to FIG. 1 thereof, there is seen a printing press 1 for printing sheets. The printing press 1 includes a plurality of printing units disposed in a line for offset printing, including a printing unit 2. The printing unit 2 includes a cylinder 3, which is a blanket cylinder. In addition, the printing unit 2 includes a printing form cylinder and an impression cylinder, which interact with the cylinder 3. The printing press 1 includes a cleaning apparatus 4 which is used for cleaning of the cylinder 3, carried out from time to time, for example between successive print jobs. The cleaning apparatus 4 can be displaced into the printing unit 2 through an opening 5 in a wall of the printing unit 2 parallel to the axis of rotation of the cylinder 3.

The cleaning apparatus 4 includes a cleaning cloth 6, which can be unwound from a clean-cloth spindle 7 and can be wound onto a dirty-cloth spindle 8. The cleaning cloth 6 runs over a pressing element 9 which, during cleaning of the cylinder 3, is used to press the cleaning cloth 6 onto the cylinder 3. The pressing element 9, just like the cleaning cloth 6, extends substantially over the entire length of the cylinder 3. A monitoring device 10 monitors tension of the cleaning cloth 6, which is to say whether the section of the cleaning cloth 6 located between the clean-cloth spindle 7 and the dirty-cloth spindle 8 is sufficiently taut. The section of the cleaning cloth 6 located between the dirty-cloth spindle 8 and the pressing element 9 is assigned a roller 11 and an incremental encoder 12, which is connected to the roller 11. The incremental encoder 12 serves as a sensor for measuring the advance of the cleaning cloth 6 when the latter is spooled. A spindle drive 13, which is to say a drive for driving the two spindles 7, 8, is provided in order to rotationally drive the clean-cloth spindle 7 and the dirty-cloth spindle 8 and includes an electric motor and a gearbox. The clean-cloth spindle 7 and the dirty-cloth spindle 8 can be driven as desired through the use of the spindle drive 13. A presence sensor 14, operating without contact, is disposed in a displacement path of the cleaning apparatus 4 in order to detect whether the cleaning apparatus 4, in the course of its displacement into the printing unit 2, has or has not already reached a specific intermediate position. Reference numeral 15 designates a sag in the cleaning cloth 6 which is located between the incremental encoder 12 and the clean-cloth spindle 7 and which is eliminated by a method described in detail below.

In FIG. 1, the cleaning apparatus 4 is shown in a maintenance position outside the printing unit 2. In this maintenance position, the cleaning apparatus 4 is easily accessible in order to change the cleaning cloth 6. In this case, the cleaning apparatus 4 stands on a protective covering, which is used to close the opening 5 (see FIG. 3). The protective covering has been folded down into a horizontal position, with the opening 5 being closed by a further protective covering.

Figure 2:
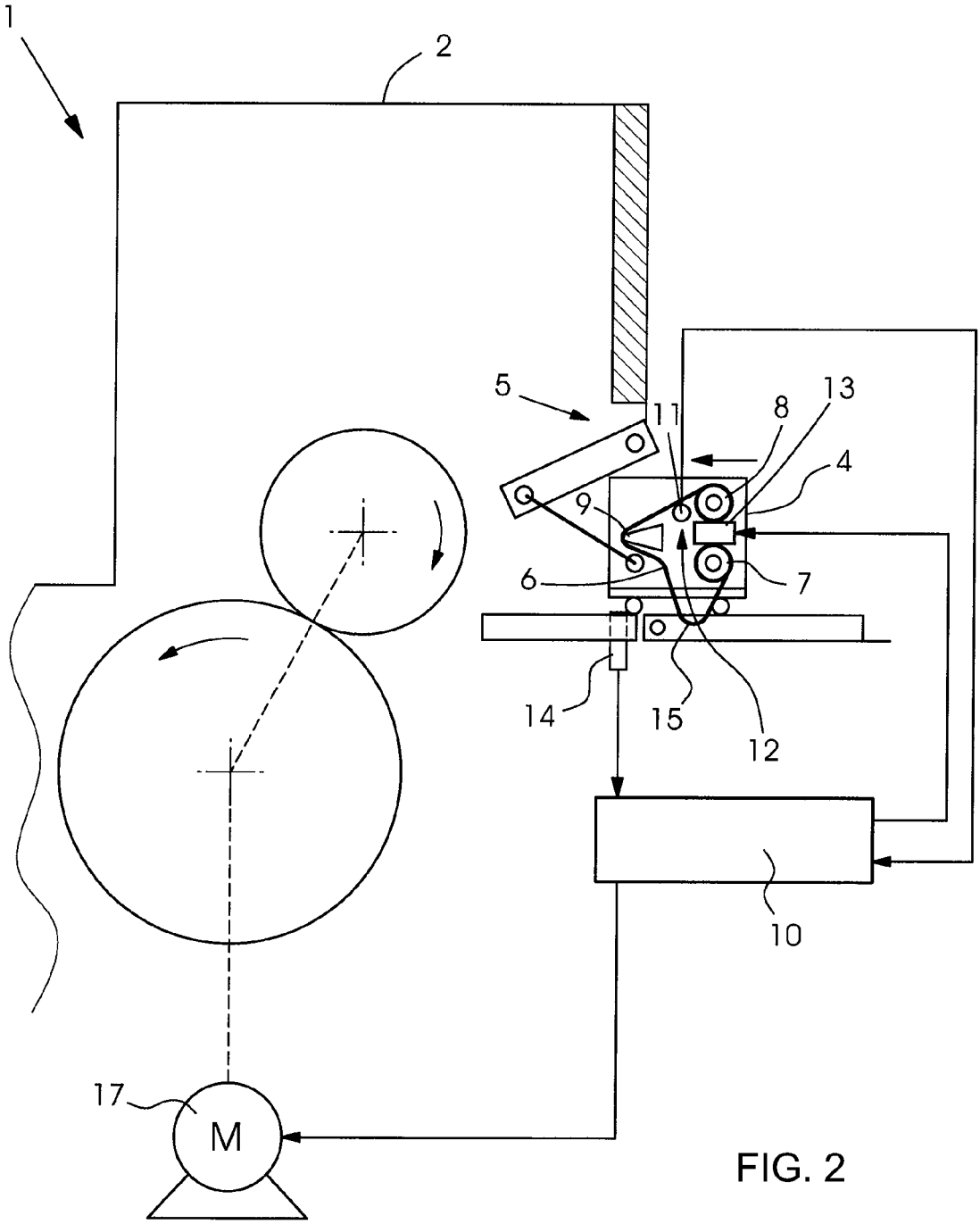
FIG. 2 is a fragmentary, side-elevational view of the printing unit and the cleaning apparatus of FIG. 1 during a displacement of the cleaning apparatus into the printing unit.

FIG. 2 shows the cleaning apparatus 4 during its displacement into the printing unit 2. The cleaning apparatus 4 is constructed as a carriage having wheels. The wheels of the cleaning apparatus 4 run on rails disposed on an upwardly pointing inner side of the protective covering which is folded down. These rails are adjoined by rails disposed within the printing unit and the presence sensor 14 is disposed on one of these rails. FIG. 2 shows a time at which the cleaning apparatus 4, in the course of its displacement along the rails, reaches the presence sensor 14, so that the presence sensor 14 responds. The presence sensor 14 can respond, for example, as a result of the fact that a side wall of the cleaning apparatus 4 comes into a position opposite the presence sensor 14.

The presence sensor 14 is also used to deactivate the incremental encoder 12 as the cleaning apparatus 4 is withdrawn from the printing unit 2, in order to ensure that, during the changing of the cleaning cloth 6 outside the printing unit 2 in the maintenance position and during running printing operation, the monitoring device 10 does not misinterpret the movement of the cleaning cloth 6 as the latter remaining stuck to the cylinder 3 and the cleaning cloth 6 being pulled into the printing unit 2, and consequently trigger an emergency stop.

Figure 3:
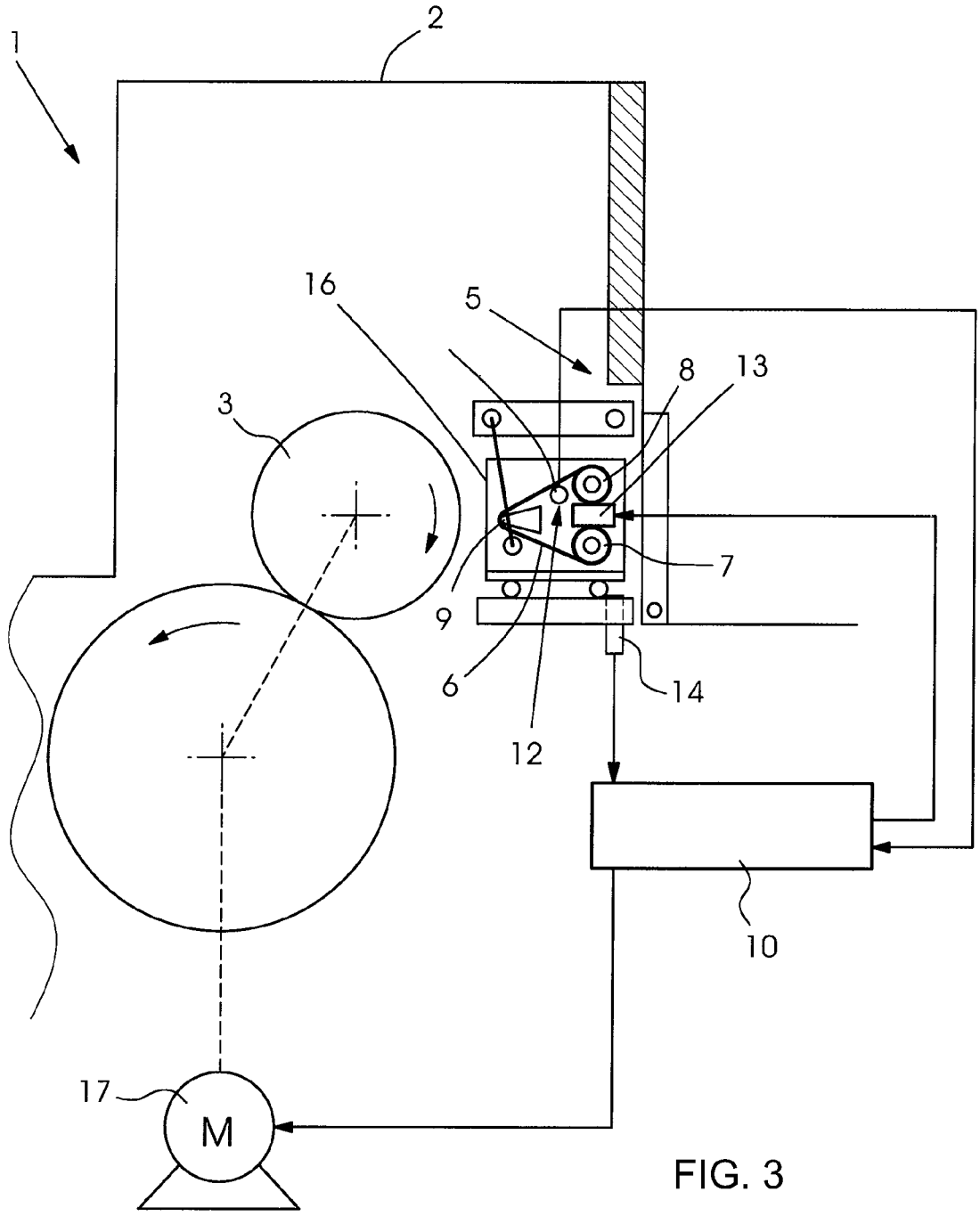
FIG. 3 is a fragmentary, side-elevational view of the printing unit and the cleaning apparatus of FIGS. 1 and 2, in which the cleaning apparatus is located in an operating position within the printing unit.

FIG. 3 shows the cleaning apparatus 4 in an operating position 16 within the printing unit 2. The front protective covering, which was folded down, now has been folded up into a vertical position in order to close the opening 5. In the operating position 16, the cleaning apparatus 4 is fixed by a non-illustrated locking device. In this operating position 16, the pressing element 9 can be moved toward and away from the cylinder. The pressing element 9 is moved toward the cylinder 3 in order to press the cleaning cloth 6 against its circumferential surface, which is formed by a blanket. The pressing element 9 is moved away from the cylinder 3 in order to bring the cleaning cloth 6 out of contact with the cylinder 3. In the operating position 16, the cleaning apparatus 4 is still in a position opposite the presence sensor 14, so that the latter is still activated.

The illustrated system functions as follows:

The cleaning apparatus 4 is located in its maintenance position, illustrated in FIG. 1, when the operator replaces the cleaning cloth 6 by a fresh one. After maintenance of the cleaning apparatus 4 has been carried out, it is pushed into the printing unit 2 by the operator along a guide formed by the rails. When the cleaning apparatus comes into a position opposite the presence sensor 14 in the process, the latter triggers a signal which signals to the monitoring device 10 that the cleaning apparatus 4 is located in the specific intermediate position. The presence sensor 14, which can also be designated as a proximity sensor, is preferably an inductively operating sensor which reacts to the material (steel) of the housing of the cleaning apparatus 4.

As soon as the monitoring device 10, which also functions as an electronic control device, has received the signal from the presence sensor 14, the control and monitoring device 10 activates the spindle drive 13 in such a way that the clean-cloth spindle 7 is set rotating in order to wind a section of the cleaning cloth 6, for example about 50 mm long, onto the clean-cloth spindle 7. If, during this winding, the roller 11 is not set into rotation by the cleaning cloth 6 rubbing on the latter and, accordingly, the incremental encoder 12 is not set into rotation either, then this is an indication that the sag 15 has not been eliminated to a sufficient extent and accordingly the cleaning cloth 6 has not yet been tautened sufficiently. As soon as the incremental encoder 12 is set into rotation, the incremental encoder 12, which is connected to a computer of the monitoring device 10, communicates this to the computer.

The computer has a predefined specific time period, which begins to run with the receipt of the signal from the presence sensor 14. If, within this specific time period, the computer receives no signal from the incremental encoder 12 which signals to the computer that the incremental encoder 12 is rotating, then the control and monitoring device 10 switches off a cylinder drive 17 which rotates the cylinder 3. This is done, for example, by the monitoring device 10 sending a so-called emergency stop signal to a central control device of the printing press 1, which causes the central control device to deactivate the cylinder drive 17. The cylinder drive 17 can, for example, be a main drive of the printing press 1 that drives a plurality of printing units of the printing press 1. As a result of switching off the cylinder drive 17, the cylinder 3 is brought to a rotational standstill.

If, within the specific time period, the computer of the monitoring device 10 receives the signal from the incremental encoder 12 which signals the rotation of the latter, then the monitoring device 10 does not switch off the cylinder drive 17. Instead, in this case the monitoring device 10 switches the spindle drive 13 over, so that the latter drives the dirty-cloth spindle 8 in order to wind the cleaning cloth 6 back onto the dirty-cloth spindle 8 again by a specific amount. As a result of winding the cleaning cloth 6 back onto the dirty-cloth spindle 8, it is likewise possible to eliminate a sag of the cleaning cloth 6, which is possibly present but not illustrated in the drawing, and is located between the incremental encoder 12 and the dirty-cloth spindle 8.

Through the use of the spooling back and forth, it is thus possible not only for the sag 15 located on one side of the sensor (incremental encoder 12) to be eliminated but also the other sag of the cleaning cloth 6 located on the other side of the sensor (incremental encoder 12). During this back and forth spooling of the cleaning cloth 6 in order to tauten the latter, the entire cleaning apparatus is pushed from its intermediate position shown in FIG. 2 further into the printing unit 2 until the cleaning apparatus 4 has reached its operating position 16 shown in FIG. 3. The printing unit 2 continues to run uninterruptedly in printing operation during the entire time, which is to say during the maintenance of the cleaning apparatus 4 outside the printing unit 2, during the displacement of the cleaning apparatus 4 into the printing unit 2, and when the cleaning apparatus 4 is positioned in the printing unit 2.

An interruption of the printing operation is caused only in the case described, in which the monitoring device 10 determines that the sag 15 is too large to be able to be tautened by winding the section of predetermined length onto the dirty-cloth spindle 8.

Figure 4:
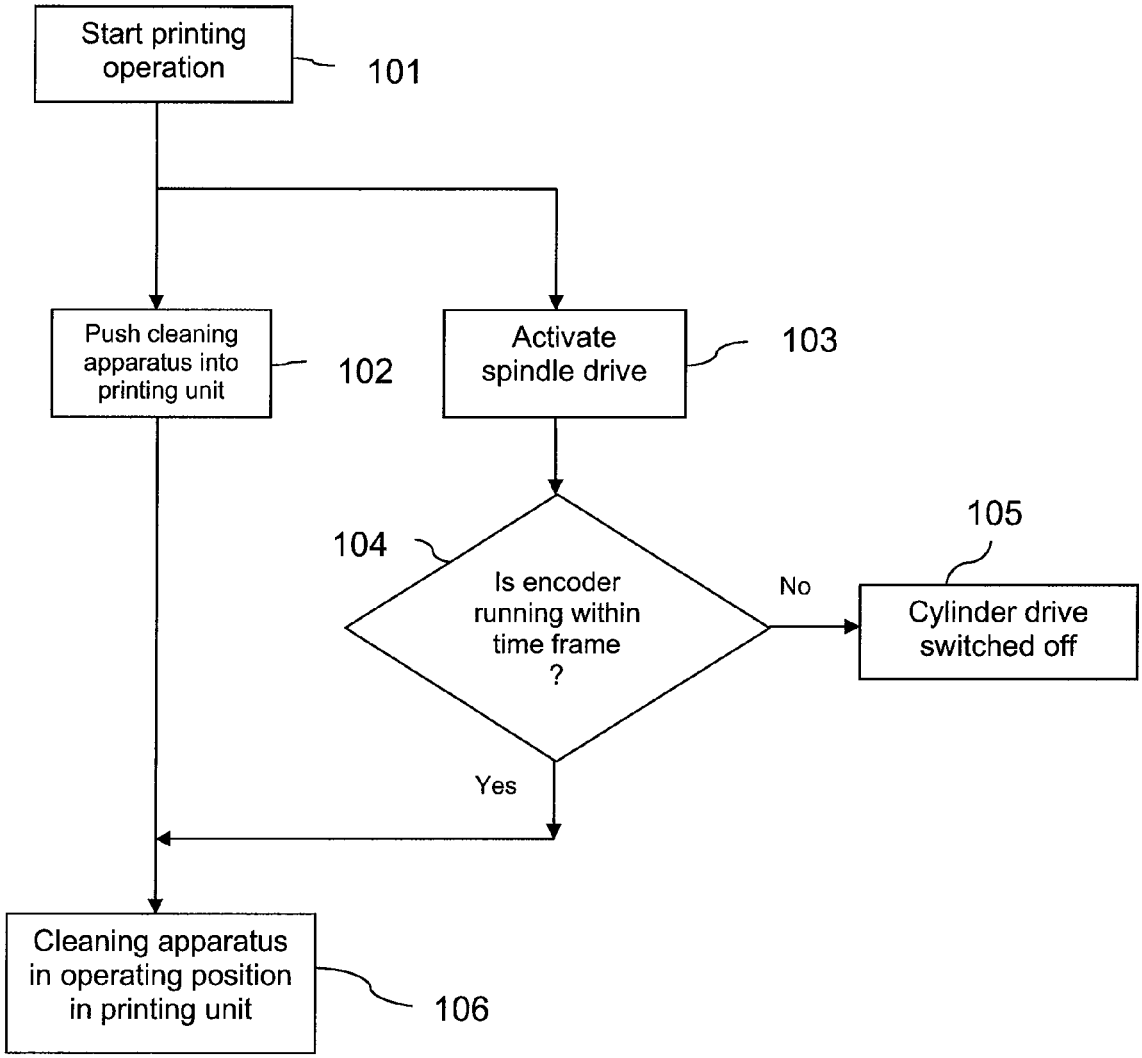
FIG. 4 is a flow chart which shows a possible sequence of a method according to the invention.

FIG. 4 shows a flow chart in which the individual method steps are illustrated once more in simplified and summarized form. In step 101, printing operation is started, with the cylinder drive 17 being activated, so that the latter drives the cylinder 3 in rotation. In the following step 102, the cleaning apparatus 4 is pushed into the printing unit 2 by the operator. In the step 103, likewise following step 101, the spindle drive 13 is activated and the cleaning cloth 6 is re-tensioned as a result. In the following step 104, the monitoring device 10 monitors whether or not the incremental encoder 12 begins to run within a specific time frame after step 103.

If the incremental encoder 12 is not set moving by the cleaning cloth 6 within the time frame, this is assessed by the monitoring device 10 as an indicator of too large an extent of the sag 15 and, consequently, in the step 105 the cylinder drive 17 is switched off or uncoupled by the emergency stop signal, so that the printing operation is interrupted and the rotation of the cylinder 3 is stopped.

If the cleaning cloth 6 sets the incremental encoder 12 rotating within the time frame, this is assessed by the monitoring device 10 as an indicator that the cleaning cloth 6 has been or can be tautened to a sufficient extent, so that the monitoring device 10 does not stop the cylinder drive 17 and allows the printing operation to continue to run, so that in the step 106 the cleaning apparatus 4 reaches its operating position 16 within the printing unit 2.

The invention claimed is:

1. A method for operating a printing press having a printing unit and a cleaning apparatus, the method comprising the following steps:

in a first step, starting the printing unit to print with the printing unit; and in a subsequent, second step, displacing the cleaning apparatus at least one of into or out of the printing unit during running of the printing unit in printing operation;

moving the cleaning apparatus into an operating position within the printing unit by the displacement carried out in the second step; and automatically re-tensioning a cleaning cloth of the cleaning apparatus after the first step and before the cleaning apparatus has reached the operating position, the automatic re-tensioning being carried out while the printing unit is running in printing operation.

2. The method according to claim 1, which further comprises carrying out the step of re-tensioning the cleaning cloth by winding the cleaning cloth onto a spindle.

3. The method according to claim 2, which further comprises monitoring the tension of the cleaning cloth with a monitoring device during the step of re-tensioning the cleaning cloth.

4. The method according to claim 3, wherein the step of monitoring of the tension of the cleaning cloth by the monitoring device determines if a sensor of the monitoring device responds within a specific time period beginning with an activation of a drive of the spindle.

5. The method according to claim 4, which further comprises interrupting the printing operation of the printing unit with the monitoring device, if the specific time period is exceeded without the sensor responding.

6. The method according to claim 1, which further comprises monitoring the tension of the cleaning cloth with a monitoring device having a sensor.

7. The method according to claim 4, wherein the sensor is an incremental encoder.

8. The method according to claim 6, wherein the sensor is an incremental encoder.

9. A printing press, comprising a printing unit and a cleaning apparatus for carrying out the method according to claim 1.

* * * * *